United States Patent [19]

Lin et al.

[11] Patent Number: 4,579,070

[45] Date of Patent: Apr. 1, 1986

[54] REDUCING MODE CIRCULATING FLUID BED COMBUSTION

[75] Inventors: Yung-Yi Lin; Pasupati Sadhukhan, both of Katy; Lowell D. Fraley, Sugarland; Keh-Hsien Hsiao, Houston, all of Tex.

[73] Assignee: The M. W. Kellogg Company, Houston, Tex.

[21] Appl. No.: 707,252

[22] Filed: Mar. 1, 1985

[51] Int. Cl.[4] ..... F23J 11/00; F23J 15/00

[52] U.S. Cl. ..... 110/345; 110/245; 110/342; 110/347; 122/4 D; 431/7

[58] Field of Search ..... 110/263, 347, 245, 342–345; 122/4 D; 431/7

[56] References Cited

U.S. PATENT DOCUMENTS

| | | | |
|---|---|---|---|
| 3,625,164 | 12/1971 | Spector | 110/1 J |
| 3,717,700 | 8/1970 | Robinson et al. | 423/244 |
| 3,784,676 | 1/1974 | Moss | 423/242 |
| 4,026,679 | 5/1977 | Collin | 48/73 |
| 4,103,646 | 8/1978 | Yerushalmi et al. | 122/4 D |
| 4,308,810 | 1/1982 | Taylor | 110/347 |
| 4,336,769 | 6/1982 | Daman | 122/4 D |
| 4,344,371 | 8/1982 | Zoschak | 110/229 |
| 4,419,940 | 12/1983 | Cosar et al. | 110/229 |
| 4,419,965 | 12/1983 | Garcia-Mallol et al. | 110/245 X |
| 4,442,797 | 4/1984 | Strohmeyer, Jr. | 110/245 X |
| 4,469,032 | 9/1984 | Yan | 110/342 |
| 4,481,892 | 11/1984 | Mah | 110/263 |

OTHER PUBLICATIONS

Hsiao et al., "Atmospheric Fluidized-Bed Combustor Design Whose Performance Will Significantly Exceed Conventional FBC Operation Performance", Dec. 1982, DOE/MC/19332-1319 (DE 83005062), pp. 2-14 to 2-19 and 2-41 to 2-43.

Taylor, "$NO_x$ Control Through Staged Combustion in Fluidized-Bed Combustion Systems", Aug. 1980, Proceedings of the Sixth International Conference on Fluid Bed Combustion, pp. 957-967.

Nack et al., "Control of Sulfur Dioxide and Nitrogen Oxide Emissions by Battelle's Multisolid Fluidized-Bed Combustion Process", Aug. 1980, Proceedings of the Sixth International Conference on Fluid Bed Combustion, pp. 979-985.

*Primary Examiner*—Edward G. Favors

[57] ABSTRACT

A method for combustion of sulfur-containing fuel in a circulating fluid bed combustion system wherein the fuel is burned in a primary combustion zone under reducing conditions and sulfur captured as alkaline sulfide. The reducing gas formed is oxidized to combustion gas which is then separated from solids containing alkaline sulfide. The separated solids are then oxidized and recycled to the primary combustion zone.

18 Claims, 1 Drawing Figure

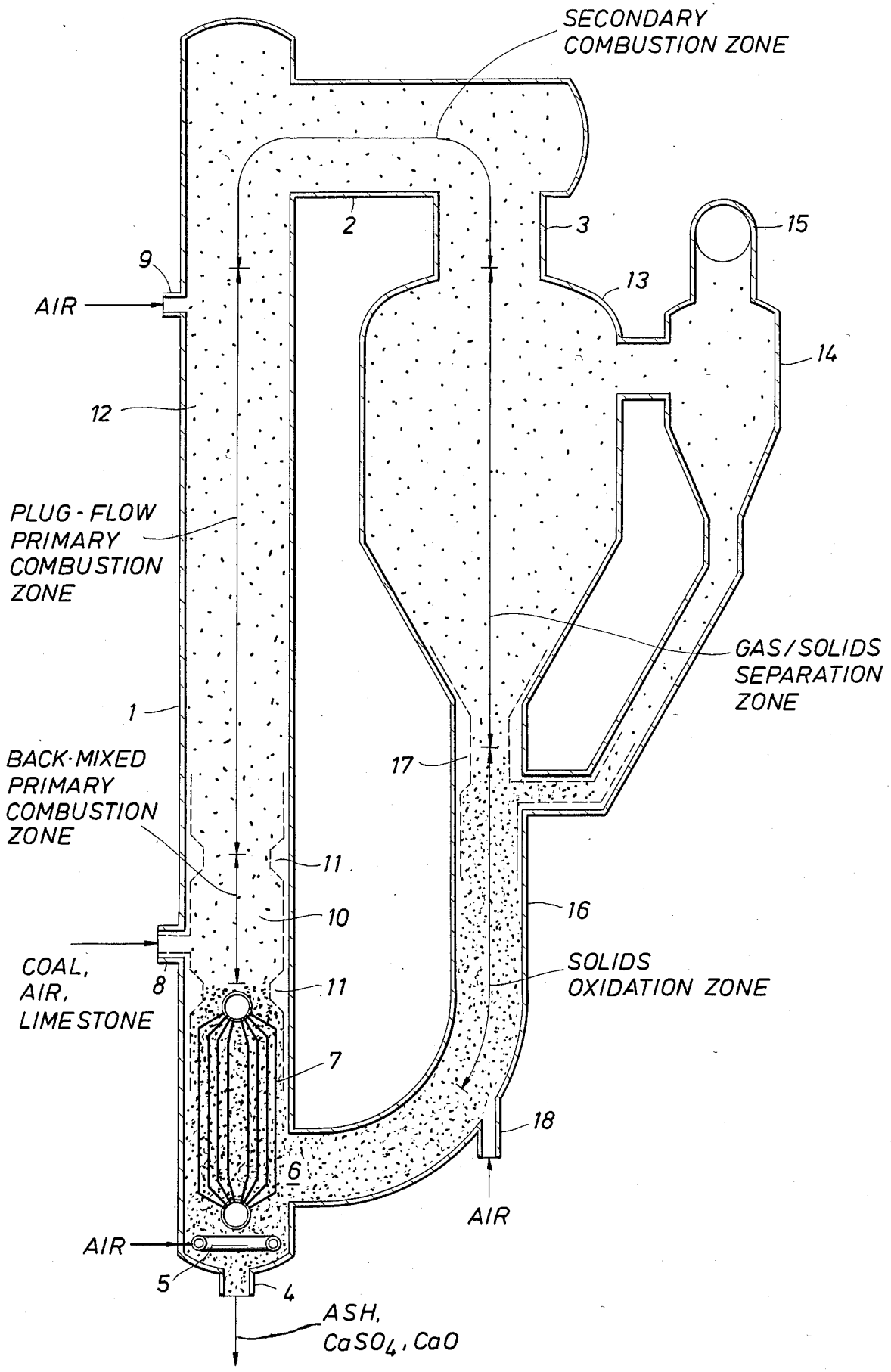
SECONDARY COMBUSTION ZONE
2
3
15
9
13
AIR
14
12
PLUG-FLOW PRIMARY COMBUSTION ZONE
GAS/SOLIDS SEPARATION ZONE
1
17
BACK-MIXED PRIMARY COMBUSTION ZONE
11
10
16
COAL, AIR, LIMESTONE
8
11
SOLIDS OXIDATION ZONE
7
18
6
AIR
AIR
5
4
ASH, $CaSO_4$, CaO

REDUCING MODE CIRCULATING FLUID BED COMBUSTION

The Government of the United States of America has rights in this invention pursuant to Department of Energy Contract No. DE-AC21-84MC21173.

This invention relates to fluid bed combustion and, more particularly, relates to circulating fluid combustion systems wherein sulfurcontaining fuel is burned in the presence of an alkaline sorbent for sulfur capture to produce combustion gas having a low sulfur content and to produce heat which may be recovered by indirect heat exchange from solids within the system and/or from the hot combustion gases produced. The system is particularly useful for production of high pressure steam from boiler feed water.

Circulating fluid bed combustion systems are gas/solids systems in which all or a major part of the solids are elutriated from a fluidized combustion zone by combustion air and gases to a dilute solids phase from which substantially sulfur-free combustion gas is recovered and, after heat recovery, discharged to the atmosphere. In the instance, for example, of steam boilers, these systems offer significant installation and operating cost advantages over conventional coal fired boilers equipped with wet scrubbing systems. Owing to lower operating temperature and the possibilities of staged combustion, they also have the characteristic of lower nitrogen oxide formation than is found possible with a conventional coal fired unit.

Circulating bed systems evolved, generally, from bubbling bed systems exemplified by U.S. Pat. No. 3,717,700 which illustrates steam raising in a coil, immersed in and above a dense, bubbling bed of limestone and burning coal. Sulfur in the coal is captured from evolved sulfur dioxide as calcium sulfate which may be discarded or regenerated as taught in the aforementioned patent. Since some solids comprising unburned coal, ash, and sulfur sorbent are elutriated from the dense, bubbling bed, these solids are separated from the combustion gas and, by various means, returned to the dense bubbling bed. U.S. Pat. No. 4,103,646 illustrates a design evolution to essentially full circulating bed systems, commonly referred to as "fast bed" systems, in which combustion and sulfation of limestone are carried out in a dilute phase fluid bed contained in a "riser". Further evolution to higher gas velocity systems commonly referred to as "transport bed" systems is exemplified in Department of Energy Report MC 19332-1319 (DE No. 83005062), where the solids, again comprising unburned coal, ash, and sulfur sorbent, are totally suspended and entrained in the fluidizing stream of combustion air. The riser discharges into a gas/solids separator for removal of combustion gas having a low sulfur content and eventual recycle of solids to the combustion zone. These transport bed systems are characterized by a high solids recirculation rate and relatively uniform temperatures, typically between 760° C. and 985° C., throughout the solids circulating loop. System pressures are typically between atmospheric pressure and two atmospheres, however, elevated pressure systems are desirable in some process applications.

Circulating fluid bed combustion systems capture sulfur by reaction of evolved sulfur dioxide with an alkaline sorbent to form the corresponding alkaline sulfate which is usually rejected with ash to waste disposal. In limestone fed systems sulfur is captured as calcium sulfate since it is naturally formed under prevailing oxidizing conditions of the combustion system and can be safely discarded. While sulfate is the final form of rejected alkaline sorbent, it is thought that alkaline sulfide, e.g.—calcium sulfide, may be transitorily formed in the initial phase of combustion. In instances where nitrogen oxide reduction has been attempted by reducing the amount of excess combustion air to an amount approaching the stoichiometric ratio required for complete combustion of fuel and contained sulfur, minor amounts of calcium sulfide have been found in solids rejected from the system. Since sulfide in the rejected solids will hydrolize to toxic hydrogen sulfide, it would then be necessary to further process the rejected solids prior to disposal. Accordingly, fluid bed combustion system designs typically provide sufficient excess combustion air and gas/solids contact time to ensure that all sulfur is rejected in the sulfate form.

These circumstances bring about several problems. Firstly, sulfur capture by the $SO_2$/sulfate route involves relatively slow reactions and, therefore, long residence times. Since combustion gases move at a high velocity, it is necessary to provide high freeboard space above the dense bubbling beds or long risers for the transport bed systems thus resulting in, for either type, more costly systems. Residence times may be reduced by feeding and rejecting larger amounts of alkaline sorbent to and from the system in order to maintain a large excess of alkaline oxide over sulfur but this alternative represents an impractical economic loss. Secondly, nitrogen oxide content of the combustion gas is known to be significantly increased by use of a large excess of combustion air that is necessary to capture sulfur under oxidizing conditions. Nitrogen oxide content may be reduced by decreasing the excess air and by employing staged combustion, however, such conditions are detrimental to sulfur capture efficiency as noted above.

It is, therefore, an object of the present invention to burn sulfurcontaining fuel in a circulating fluid bed combustion system in such manner that combustion gas is produced having a low sulfur, low nitrogen oxide content while, at the same time employing an economically low ratio of alkaline sorbent to fuel sulfur content.

According to the invention, sulfur-containing fuel is burned in a circulating solids fluid bed combustion system having a primary combustion zone, a secondary combustion zone, a gas/solids separation zone, a solids oxidation zone, and, usually, indirect heat exchange means by introducing fresh alkaline sorbent to the system, introducing sulfur-containing fuel to the primary combustion zone along with sufficient combustion air to partially oxidize the fuel to reducing gas while capturing sulfur released from the fuel as alkaline sulfide in entrained solids, introducing the gases and solids to a secondary combustion zone where sufficient air is introduced to burn the reducing gas to oxidized combustion gas, separating the combustion gas from entrained solids still containing alkaline sulfide, oxidizing the separated solids, and recycling the oxidized solids comprising alkaline oxide and alkaline sulfate to the primary combustion zone.

The drawing illustrates a transport bed type circulating fluid bed combustion system that is suitable for carrying out the method of the invention in a most preferred manner later specifically described in an illustrative embodiment.

The sulfur-containing fuel employed will typically be a pulverized solid fuel such as coal, lignite, or petroleum coke but may be suitably prepared woody and fibrous materials. Liquid fuels such as heavy petroleum residues, shale oil liquids, black liquor from pulping, heavy coal liquefaction products, and solid/liquid fuel combinations may also be suitably employed. In steam power and steam raising applications, bituminous type coal having a sulfur content between 0.5 and 5 weight percent is the most commonly employed fuel.

The alkaline sorbent employed in the method of the invention will most commonly be introduced as limestone owing to its low cost and wide availability. Dolomitic limestone may be used, however, only the calcium component is available for sulfur acceptance. Lime may be used in lieu of limestone but is an unnecessary, costly alternative since limestone is readily converted to calcium oxide during its recirculation through the system. In a transport bed system, fresh limestone will normally be converted to oxide form within two to three cycles through the system. Other suitable alkaline sorbents are oxides, hydroxides, and carbonates of sodium and potassium. When pulverized oil shale is burned, the nahcolite component of the shale is a suitable sorbent.

Particle size of both the alkaline sorbent and fuel (when solid fuel is employed) will be a function of the fluidized system overall design and the extent of solids elutriation that is desired and solids attrition expected. In general, circulating systems employing a dense phase fluid combustion bed that is back-mixed by upward passage of primary combustion air will have average particle sizes between 500 and 5000 microns and a solids density between 320 and 960 kg/m$^3$ within the bubbling bed. Superficial gas velocities in such beds will be between 0.03 and 3 m/sec. On the other hand, transport bed systems having a dilute phase fluid combustion bed will employ average particle sizes between 20 and 500 microns and a solids density in the dilute phase zones between 8 and 320 kg/m$^3$. In transport bed systems employing solid particulate fuel and limestone, we prefer to use fuel average particle sizes between 40 and 250 microns and limestone average particle sizes between 30 and 250 microns within the system.

The fresh alkaline sorbent may be introduced to any part of the system but is preferably introduced downstream of the point at which ash, sulfated sorbent, and unreacted sorbent are purged from the system and is most preferably introduced to the primary combustion zone in order to provide the longest possible contact time with sulfur released from fuel burning in the primary combustion zone. For coal/limestone systems, the mole ratio of calcium to sulfur in the coal will typically be from 0.8 to 2.5.

The primary combustion zone is operated under partial oxidation conditions including operating temperatures between 650° C. and 1095° C. and pressure between atmospheric pressure and two atmospheres. Preferably, the primary combustion zone comprises a lower, back-mixed zone and an upper, dilute solids phase zone arranged such that all of the sulfurcontaining fuel is introduced to the lower, back-mixed zone where it may likewise enjoy the longest possible contact time with the relatively large amount of alkaline sorbent recycled to the primary combustion zone as well as any fresh sorbent introduced at this point. Most of the fuel will be consumed in the lower, back-mixed zone by introduction of less than a stoichiometric amount of primary air sufficient to burn the fuel and produce reducing gas.

In the instance of a transport bed system, the lower, back-mixed zone is operated under dilute phase, turbulent mixing conditions which provide rapid fuel burn-up as well as a means for entraining recycle oxidized solids into the primary combustion zone. Typically, under steady state conditions, fuel is introduced to the dilute phase, back-mixed zone at a rate from 0.03 to 1 weight percent of the recycle oxidized solids and fresh sorbent added, preferably with the fuel, at a rate from 0.01 to 0.5 weight percent of the recycle oxidized solids. Gas residence time in the dilute phase, back-mixed zone will be between 0.2 and 2 seconds. Due to "slip" resulting from entrainment of recycle oxidized solids from a lowermost dense bed, solids residence time in the dilute phase, back-mixed zone will be somewhat longer. From 30 to 98 weight percent of the fuel carbon will be converted to carbon oxides and, usually, hydrogen according to moisture and hydrogen contents of the fuel within the back-mixed zone.

Complete conversion of fuel to reducing gas takes place in the upper, dilute solids phase zone with the already introduced primary combustion air or with additionally introduced primary air provided, however, that the cumulative supply of primary air to the primary combustion zone is provided in an amount between 40 and 95 volume percent of stoichiometric air in order to maintain reducing conditions in the primary combustion zone. As the solids comprising alkaline oxide and sulfate together with ash pass upwardly through the primary combustion zone entrained in the fluidizing gases, sulfur evolved from the fuel principally as hydrogen sulfide reacts with a minor portion of the alkaline oxide to form the corresponding alkaline sulfide. The sulfur reactions are quite complex but may be regarded here as evolution and formation of hydrogen sulfide with substantially simultaneous reaction of hydrogen sulfide and alkaline oxide. Since no sulfur dioxide is produced under the equilibrium reducing conditions, there is scant opportunity for formation of incremental alkaline sulfate, however, we hypothesize that alkaline sulfate present in the recycle solids takes part in the combustion and sulfur reactions as, possibly, a transfer mechanism. It is necessary to provide sufficient gas/solids contact time in the primary combustion zone to react substantially all of the fuel sulfur to alkaline sulfide such that only traces of hydrogen sulfide exist in the gas leaving the primary combustion zone. In the case of a bubbling bed system, sufficient freeboard must exist above the bed surface to provide contact time as the gases and solids move upwardly in the reducing environment. Sufficient contact time may be ensured through preferred use of plug-flow conditions in the upper, dilute phase zone as may be carried out with a riser conduit found in transport bed systems. Preferably, such plug-flow conditions will include a solids density between 8 and 320 kg/m$^3$ and a superficial gas velocity between 3 and 17 m/sec. Most preferably, such systems will employ a gas residence time in the wholly dilute phase primary combustion zone between 1 and 3 seconds. In a riser system, which includes the primary combustion zone and the later described secondary combustion zone, slip approaches zero about halfway up the dilute phase length of the riser. That is to say that the solids velocity is nearly the same as the gas velocity. When coal is burned in the foregoing preferred embodiment and limestone is the fresh sorbent, air will be introduced to the primary combustion zone in an amount between 55 and 90 volume percent of the stoichiometric air. In a transport bed system operated with coal under these conditions, hydrogen sulfide level will decline from typically about 700 ppm at the inlet of the plug-flow, upper dilute phase zone to typically below 100 ppm at its outlet owing to reaction of hydrogen sulfide with alkaline oxide.

The primary combustion zone ends and the secondary combustion zone begins with the introduction of secondary air to the stream of entrained solids now comprising alkaline sulfate, oxide, and sulfide carried in a gas stream comprising nitrogen and reducing gas that has only low levels of sulfurous gases as hydrogen sulfide. Secondary air is introduced to the secondary combustion zone in sufficient amount to burn the reducing gas to oxidized combustion gas having a low sulfur content. Usually, any residual solid fuels not burned in the primary combustion zone will be quickly burned upon contact with the secondary air. The secondary air amount will bring the cumulative combustion air supply to between 100 and 130 volume percent of the stoichiometric air. In contrast to the primary combustion zone which is substantially free of molecular oxygen, the secondary combustion zone contains between 1 and 8 mole percent molecular oxygen. While the introduction of combustion air has been described in terms of primary air and secondary air introductions, both primary air and secondary air may be divided into multiple air injections as may be desired to accommodate burning characteristics of various fuels, the physical configuration of the circulating bed system, and the nitrogen oxide target level in the combustion gas. Physical characteristics of the system between the secondary air inlet and downstream gas/solids disengagement devices or chambers will normally provide more than enough gas residence time for complete combustion of the reducing gas and any residual fuel and conversion of low level hydrogen sulfide to sulfur dioxide but will be insufficient to evolve sulfurous gases from the entrained solids. Preferably, the secondary combustion zone is a physical extension of the upper, dilute solids phase portion of the primary combustion zone such as the riser conduit of a transport bed system operating under similar plug-flow conditions but, usually, with a higher superficial gas velocity between 6 and 30 m/sec. Under these conditions, the riser must be sufficiently long that the secondary combustion zone can be operated with a minimum gas residence time of 0.25 seconds, preferably with a gas residence time between 0.3 and 1 second.

The combustion gas and entrained solids, still comprising ash, alkaline oxide, sulfate, and typically a fractional weight percent alkaline sulfide up to as much as 3 weight percent depending upon fuel sulfur content, is introduced to a gas/solids separation zone from the secondary combustion zone. The separation zone may be an extended section of the secondary combustion zone of sufficient flow cross-section to decrease gas/solids velocity to the point at which gravity separation of solids occurs. In transport bed systems, it is preferable to utilize the high gas/solids velocity existing at the riser outlet of the secondary combustion zone in inertial separation devices employing directional flow changes such as cyclones or disengagement chambers having provision for gas flow reversal. Under full load conditions, the riser gas outlet velocity may range between 15 and 30 m/sec. High velocities are used at full load conditions and low velocities are used under turndown conditions. Within the upper range of full load outlet velocities, the overall gas residence time from the riser fuel inlet to the gas/solids disengagement zone will typically be between 2 and 4 seconds and solids residence time will be between 3 and 10 seconds. Combustion gas having a low sulfur content recovered from the gas/solids separation zone is then passed to a convection section for extraction of high and low level heat by suitable coils in services such as steam superheating, boiler feedwater heating, combustion air preheat or other services consistent with the particular application. Following low level heat extraction, the combustion gas will typically undergo final dust removal in, for example, a baghouse and be discharged to the atmosphere.

Solids, still containing alkaline sulfide, recovered from the gas/solids separation zone are introduced to a fluidized solids oxidation zone operated between 590° and 985° C. and are there contacted with air at a solids residence time at least between 1 and 30 seconds to convert substantially all of the alkaline sulfide in the separated solids to alkaline sulfate. Since conversion of alkaline sulfide to the sulfate is relatively slow for large particles, the solids oxidation step is preferably carried out in a dense, bubbling bed fluidized by the oxidizing gas stream at a solids residence time between 1 and 50 seconds and a temperature in the range from 760° to 920° C. The amount of air introduced to the solids oxidation zone and the necessary contacting time will be sufficient to oxidize the alkaline sulfide. The air for solids oxidation is supplemental to the combustion air requirements of the primary and secondary combustion zones and is usually directly related to sulfur content of fuel to the combustion system. Typically the air amount will be equivalent to from 1 to 5 volume percent of the stoichiometric air for combustion. A dense bed solids oxidation zone is preferably employed in a transport bed combustion system in order to provide the required solids residence time and will be at sufficient height to develop fluidization back pressure for circulation of solids through the dilute phase primary and secondary combustion zones. Under these conditions, the solids oxidation zone is preferably operated at or near the riser outlet temperature.

Oxidized solids recovered from the solids oxidation zone are substantially sulfide-free and comprised predominantly of alkaline oxide, alkaline sulfate, and ash plus inerts. In the instance of coal feeds with high calcium limestone as the alkaline sorbent, these solids will typically contain from 20 to 85 weight percent calcium sulfate, from 5 to 15 weight percent calcium oxide, from 25 to 75 weight percent ash plus inerts, and only trace amounts of calcium carbonate. A minor portion of the oxidized solids are intermittently or continuously purged from the system prior to solids recycle to the primary combustion zone in order to maintain relatively low concentrations of ash and alkaline sulfate in the circulating bed system.

Indirect heat exchange means may suitably be included in various parts of the circulating bed system according to its physical configuration but are preferably located in the downstream portion of the solids oxidation zone or in a separate heat exchange zone located between the solids oxidation zone and the primary combustion zone. Such locations are preferred since the metallic heat exchange surfaces will thereby be exposed to only fully oxidized solids which have considerably less corrosive effect than solids containing alkaline sulfide and/or hydrogen sulfide found elsewhere in the system. Additionally, the dense bed conditions found in the solids oxidation zone or a downstream heat exchange zone provide significantly better heat transfer characteristics as compared with dilute phase solids beds.

Finally, as previously noted, the oxidized solids are, after removal of a purge stream, recycled to the primary combustion zone by either mechanical or solids fluidization means and re-entrained into, preferably, the lower, back-mixed zone of the primary combustion zone.

Referring now to the drawing, there is shown a circulating fluid bed combustion system of the transport bed type that is particularly suited to carrying out the method of the invention in a steam boiler application. The system comprises a "folded riser" for combustion including a vertical riser 1, a crossover 2, and a short downcomer 3 for clockwise flow of solids. The folded riser has a circular cross-section with an effective diameter of 2.4 meters and, like other parts of the system exposed to high temperature and circulating solid particles, is lined with castable, refractory insulation shown in part by dotted lines on the drawing. The vertical riser is 33.5 meters in height overall (including the heat exchange section) and is provided with purge solids outlet 4 at the bottom of the riser, air sparge ring 5 for fluidization of dense fluid bed 6 at the lower portion of the riser, a vertical evaporator coil 7 for steam generation from boiler feed water, feed and primary air inlet 8, and secondary air inlet 9. The feed and primary air inlet 8 discharges into a dilute phase gas/solids mixing section 10 defined by constricting necks 11 formed from the refractory insulation and generally described on the drawing as the Back-mixed Primary Combustion Zone. The constricting necks effectively divide the vertical riser into three different solids fluidization zones the first being dense, bubbling bed 6, the second being mixing section 10 which contains a dilute suspension of solid particles in a very turbulent, back-mixed condition, and the third being plug-flow section 12 located above the mixing section and which contains a dilute suspension of solid particles in plug flow with the gas. That is to say, it is characterized by each gas particle having approximately the same residence time.

Secondary air inlet 9 is located in the upper portion of the vertical riser and, generally, demarcates the end of the primary Combustion Zone and the beginning of the Secondary Combustion Zone which extends through crossover 2 and downcomer 3. The length of the Primary and Secondary Combustion Zones within the folded riser is 29 meters.

The transport fluid bed combustion system additionally comprises primary disengager 13 located adjacently below the downcomer for initial separation of solids from the carrier gas and a plurality of cyclones 14 (only one shown on drawing) arranged in a ring around the primary disengager. The cyclones discharge hot combustion gas through ring manifold 15 to a convection section (not shown) for further heat recovery and then to a baghouse (also not shown) for final dust removal. Both the primary disengager 13 and the cyclones 14 discharge hot solid particles to standpipe 16 which contains an extension of dense fluid bed 6 up to constricting neck 17 located between the top of the standpipe and the bottom of primary disengager 13. Neck 17 also provides a transition between dilute phase and dense phase solids flow. Air inlet 18 is provided in the lower section of standpipe 16 to discharge oxidizing gas into the region generally identified on the drawing as the Solids Oxidation Zone. Additional fluidization air inlets (not shown) are provided in the return bend at the bottom of standpipe 16 and in the solids legs of the secondary cyclones 14 to maintain fluidization and control solids flow.

Operation of the system using Pittsburgh No. 8 bituminous coal containing 4.3 weight percent sulfur, 8.5 weight percent ash, and 3.3 weight percent water ground to an average particle size of 50 microns with Greer limestone as fresh alkaline sorbent for sulfur capture containing 90 weight percent calcium carbonate ground to an average particle size of 30 microns is described below.

2.1 kg/sec of coal and 0.47 kg/sec of limestone are mixed together with 16.3 kg/sec of air and injected into mixing section 10 through inlet 8. Approximately 97 weight percent of the coal is burned in the mixing section under partial oxidation conditions including a temperature of 900° C. and a pressure of 1.15 kg/cm$^2$ to produce a reducing gas stream passing through upper neck 11 having the following composition:

Oxygen—0 mole %
Nitrogen—68.9 mole %
Carbon dioxide—13.7 mole %
Carbon monoxide—6.3 mole %
Hydrogen—2.8 mole %
Hydrogen sulfide—1510 ppm.
$NO_x$—74 ppm.
Sulfur dioxide—0 ppm.

Turbulent flow conditions within the mixing section entrain approximately 978 kg/sec of recycle oxidized solids from dense bed 6. The recycle solids are comprised of approximately 52 weight percent $CaSO_4$, 14 weight percent CaO, trace $CaCO_3$, and 34 weight percent ash plus inerts. The combined gas/solids mixture passes upwardly through vertical riser 1 due to back pressure from the approximately 12 m high solids leg in standpipe 16 in substantially plug flow at a superficial gas velocity of 13.7 m/sec, a solids density of about 16 kg/m$^3$, and a solids flow rate of 979 kg/sec determined in the vertical riser at a point proximately below secondary air inlet 9. At this location, approximately 18 meters above the mixing section, partial oxidation of the coal is essentially complete and nearly all of the sulfur constituents in the coal have evolved as hydrogen sulfide and reacted with a minor portion of calcium oxide in the entrained solids to form calcium sulfide. In view of the fact that the fresh feed rate is low in comparison with the rate of solids circulation in the system, calcium sulfide content of the entrained solids is a fraction of one weight percent. Except for diminution of the hydrogen sulfide content to about 65 ppm, the gas composition is little changed from that leaving the mixing section. From the foregoing, it may be appreciated that the Plug-flow Primary Combustion Zone in vertical riser 1 functions principally as a hydrogen sulfide/calcium oxide reactor.

At secondary air inlet 9, 7.6 kg/sec of secondary air is introduced to the vertical riser which provides sufficient air in cumulative stoichiometric excess to oxidize residual coal and the reducing gas component of the gas/solid stream but, owing to insufficient residence time in crossover 2 and downcomer 3 of the plug-flow folded riser, does not significantly oxidize the calcium sulfide component in the entrained solids. Under these gas-phase oxidizing conditions, hydrogen sulfide and any residual coal sulfur are oxidized to sulfur dioxide at tolerable emission levels and the combustion gas stream entering primary disengager 13 from the Secondary Combustion Zone has the following composition:

Oxygen—1.9 mole %

Nitrogen—74.1 mole %
Carbon dioxide—14.7 mole %
Carbon monoxide—tace
Hydrogen—0
Hydrogen sulfide—0
$NO_x$—43 ppm.
Sulfur dioxide—99 ppm.

As previously recited, combustion gas is separated from the entrained solids in primary disengager 13 and secondary cyclones 14. The primary disengager removes about half of the solids through a combination of velocity reduction and gas flow path reversal. The combustion gas is at a temperature of about 900° C. and flows via manifold 15 to downstream heat recovery sections at the rate of 25.7 kg/sec.

Separated solids containing calcium sulfide descend from the disengager and cyclones to the upper portion of standpipe 16 to form a dense fluid bed which extends downwardly to the bottom of vertical riser 1. 0.8 kg/sec of air are introduced through inlet 18 (and other fluidization air inlets not shown) to oxidize substantially all of the calcium sulfide component of the separated solids to calcium sulfate in the Solids Oxidation Zone generally defined within the standpipe. A dense fluid bed having a solids density of 641 kg/m$^3$ and a superficial gas velocity of 0.6 m/sec is employed in combination with large inventory of circulating solids so that sufficient solids residence time of 32 seconds is available for the relatively slow oxidation of calcium sulfide to the sulfate. At the standpipe temperature of 900° C., little or no sulfur dioxide is formed. Oxidized solids from the Solids Oxidation Zone pass through the lower portion of dense bed 6 to complete the circulating loop and 0.66 kg/sec of the oxidized solids are purged from outlet 4 to bleed ash and calcium sulfate from the system at substantially the rate they are formed. The remaining, much greater, portion of the oxidized solids are passed across and around evaporator coil 7 and recycled to mixing section 10.

The system described above has a heat release of $54.7\times10^6$ k-cal/hr of which 56 percent or $30.7\times10^6$ k-cal/hr is released in evaporator coil 7 within the circulating solids loop as 263° C. saturated steam which is subsequently superheated to 400° C. in the hot gas convection section. In the aforedescribed system, which employs a calcium to sulfur mole ratio of 1.5, limestone utilization is 60 percent and the sulfur removal achieved is 90 weight percent.

If the system physically described above is operated at the same coal and limestone feed rates but, in contrast to the invention, fuel combustion is carried out under traditional oxidizing conditions and sulfur is captured from evolution of sulfur dioxide, the sulfur removal declines to 79 weight percent. In order to improve sulfur removal to performance levels of the embodiment of the invention given above, the combustion zone riser length would need to be extended by 26 meters in order to provide sufficient solids residence time for the sulfur dioxide reaction with calcium oxide. Aside from the significant installation cost increase resulting from the longer riser, pressure drop in the system would increase from 0.133 kg/cm$^2$ to 0.163 kg/cm$^2$ and, therefore, increase the operating cost of supplying combustion air.

We claim:

1. A method for burning sulfur-containing fuel in a circulating fluid bed combustion system which comprises:

(a) introducing recycle oxidized solids comprising predominantly alkaline oxide and alkaline sulfate to a primary combustion zone;
(b) introducing fresh alkaline sorbent to the circulating fluid bed combustion system;
(c) introducing sulfur-containing fuel to the primary combustion zone;
(d) introducing sufficient primary air to the primary combustion zone to burn the sulfur-containing fuel under partial oxidation conditions and produce reducing gas and entrained solids comprising alkaline sulfate, alkaline oxide, and alkaline sulfide;
(e) introducing the reducing gas and the entrained solids to a secondary combustion zone;
(f) introducing sufficient secondary air to the secondary combustion zone to burn substantially all the reducing gas and produce oxidized combustion gas having a low sulfur content and entrained solids containing alkaline sulfide;
(g) introducing the combustion gas having a low sulfur content and the entrained solids containing alkaline sulfide to a gas/solids separation zone and recovering separated solids containing alkaline sulfide therefrom;
(h) introducing separated solids containing alkaline sulfide to a solids oxidation zone and introducing sufficient air to the solids oxidation zone to convert substantially all of the alkaline sulfide in the separated solids to alkaline sulfate;
(i) recovering oxidized solids comprising predominantly alkaline oxide and alkaline sulfate from the solids oxidation zone;
(j) recovering at least a major portion of the oxidized solids as the recycle oxidized solids; and
(k) recovering the combustion gas having a low sulfur content from the gas/solids separation zone.

2. The method of claim 1 wherein the primary combustion zone comprises a lower, back-mixed zone and an upper, dilute solids phase zone and all of the sulfur-containing fuel is introduced to the lower, back-mixed zone.

3. The method of claim 2 wherein the fresh alkaline sorbent is introduced to the lower, back-mixed zone.

4. The method of claim 2 wherein primary air is introduced to the primary combustion zone in an amount between 40 and 95 volume percent of stoichiometric air and at least a major portion of the primary air is introduced to the lower, back-mixed zone.

5. The method of either claim 1 or claim 2 wherein the fresh alkaline sorbent is limestone and the sulfur-containing fuel is a solid fuel.

6. The method of claim 1 wherein the partial oxidation conditions within the primary combustion zone include an operating temperature between 650° C. and 1095° C. and an operating pressure between atmospheric pressure and 2 atmospheres.

7. The method of either claim 1 or claim 4 wherein the secondary air is introduced to the secondary combustion zone in such amount that the cumulative supply of air to the primary and secondary combustion zones is between 100 and 130 volume percent of stoichiometric air.

8. The method of claim 2 wherein the upper, dilute solids phase zone within the primary combustion zone is substantially free of molecular oxygen and the secondary combustion zone contains between 1 and 8 mole percent molecular oxygen.

9. The method of claim 1 wherein the solids oxidation zone comprises a fluid bed operated within the temperature range from 590° to 985° C. and the separated solids are contacted with air at a solids residence time at least between 1 and 30 seconds.

10. The method of claim 2 wherein the lower, back-mixed zone within the primary combustion zone comprises a dense solids phase fluid bed having a solids density between 320 and 960 kg/m$^3$.

11. The method of claim 2 wherein the circulating fluid bed combustion system is operated within the temperature range between 760° C. and 985° C. and the primary and secondary combustion zones comprise dilute phase fluid beds having a solids density within the range between 8 and 320 kg/m$^3$.

12. The method of claim 11 wherein the primary combustion zone comprises a lower, dilute solids phase, back-mixed zone and an upper, dilute solids phase zone operated under substantially plug-flow conditions.

13. The method of claim 12 wherein the fresh alkaline sorbent is limestone and the sulfur-containing fuel is coal introduced to the lower, dilute solids phase, back-mixed zone and primary air is introduced to the primary combustion zone in an amount between 55 and 90 volume percent of stoichiometric air.

14. The method of claim 11 wherein the primary combustion zone is operated with a gas residence time between 1 and 3 seconds.

15. The method of claim 11 wherein the secondary combustion zone is operated with a minimum gas residence time of 0.25 seconds.

16. The method of claim 11 wherein the solids oxidation zone comprises a dense phase fluid bed operated within the temperature range from 760° to 920° C. and with a solids residence time between 1 and 50 seconds.

17. The method of claim 16 wherein separated solids in the solids oxidation zone are at sufficient height to develop fluidization back pressure for the primary and secondary combustion zones.

18. The method of claim 11 wherein the steady state weight flow ratio of recycle oxidized solids to fresh alkaline sorbent is between 200 and 10,000 and the steady state weight flow ratio of recycled oxidized solids to sulfur-containing fuel is between 100 and 3300.

* * * * *